United States Patent [19]

Woodall et al.

[11] 4,290,879

[45] Sep. 22, 1981

[54] REMOVAL OF CARBONYL SULFIDE FROM LIQUID HYDROCARBON STREAMS

[75] Inventors: Robert M. Woodall; Eugene Damron, both of New Orleans, La.; Martin B. Mick, Pensacola, Fla.

[73] Assignee: Exxon Production Research Company, Houston, Tex.

[21] Appl. No.: 713,171

[22] Filed: Aug. 10, 1976

[51] Int. Cl.[3] ..... C10G 19/073

[52] U.S. Cl. ..... 208/232; 208/233; 208/234; 208/235

[58] Field of Search ..... 208/232, 233, 234, 235, 208/230

[56] References Cited

U.S. PATENT DOCUMENTS

| | | | |
|---|---|---|---|
| 2,028,335 | 1/1936 | Kalichevsky | 208/230 |
| 2,146,353 | 2/1939 | Rosebaugh | 208/232 |
| 3,000,817 | 9/1961 | DeRycke et al. | 208/232 |
| 3,812,200 | 5/1974 | Grey et al. | 208/234 |

OTHER PUBLICATIONS

Kirk-Othmer, *Encyclopedia of Chemical Technology,* Second Edition, vol. 19, p. 373.

*Primary Examiner*—Curtis R. Davis
*Attorney, Agent, or Firm*—John S. Schneider

[57] ABSTRACT

Carbonyl sulfide is removed from propane and other similar liquefied petroleum gas products by mixing liquid methanol with the untreated liquefied gas and then contacting the liquid mixture with solid potassium hydroxide.

5 Claims, 1 Drawing Figure

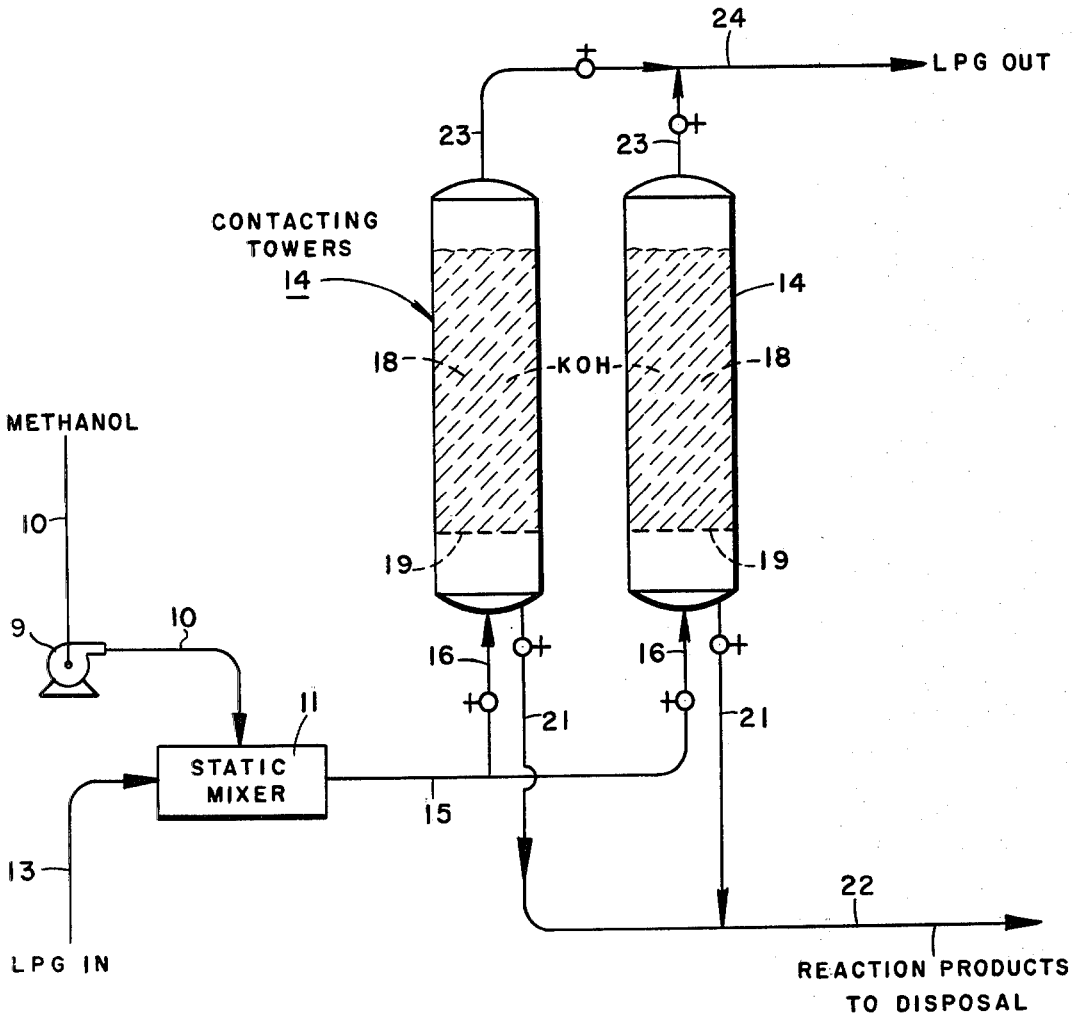
24
LPG OUT
23
23
CONTACTING TOWERS
14
14
18
KOH
18
METHANOL
10
19
19
9
10
16
16
11
21
21
STATIC MIXER
15
13
22
LPG IN
REACTION PRODUCTS TO DISPOSAL

REMOVAL OF CARBONYL SULFIDE FROM LIQUID HYDROCARBON STREAMS

BACKGROUND OF THE INVENTION

The present invention concerns removing carbonyl sulfied (COS) from liquid hydrocarbon streams and, particularly, from propane and other similar liquefied petroleum gas streams (LPG).

In oil and gas production operations carbonyl sulfide sometimes occurs in propane and other related liquefied petroleum gas products. If the carbonyl sulfide comes in contact with water in tank cars, pipelines, storage caverns etc. used to transport or store the liquified gas products it may convert to hydrogen sulfide ($H_2S$) in the presence of a heavy metal catalyst such as iron or aluminum. If more than one $PPM_v$ (parts per million by volume) of hydrogen sulfide is produced from the resulting reaction the liquefied gas products will not meet the Gas Producers Association (GPA) copper strip corrosion test specification. Carbonyl sulfide is a stable unreactive compound that is very difficult to reduce to concentration levels below one $PPM_v$ using conventional amine and molecular sieve processes. The present invention is designed to reduce the carbonyl sulfide content of a liquefied petroleum gas product to less than one $PPM_v$ expediently, economically, and with negligible energy consumption.

SUMMARY OF THE INVENTION

In accordance with the invention a liquified petroleum gas product containing carbonyl sulfide is mixed with liquid methanol ($CH_3OH$) and then contacted with solid potassium hydroxide (KOH) to remove carbonyl sulfide from the liquefied gas product. The overall reaction is:

$$KOH + CH_3OH + COS \rightarrow H_2O + KSCOOCH_3$$

DESCRIPTION OF THE PREFERRED EMBODIMENTS

Referring to the sole FIGURE in which the process of the invention is illustrated liquid methanol is pumped by means of a pump 9 through a conduit 10 into a mixer 11, which may be a static mixer as shown. An LPG stream is fed into mixer 11 through a conduit 13 and the two streams are mixed or blended together. The mixed stream flows into the bottom of one of the contacting towers 14 through conduits 15 and 16. Each tower 14 contains a bed of solid potassium hydroxide 18 supported by a suitable screen 19. The liquid mixture flows upward through the solid potassium hydroxide bed 18 where the carbonyl sulfide is removed in the reaction between potassium hydroxide, methanol and carbonyl sulfide to yield the reaction products water and $KSCOOCH_3$. Those products are periodically drawn off the bottom of each tower through conduits 21 and 22. The treated LPG stream is removed from the top of each tower through lines 23 and 24.

The process has been used to successfully treat propane streams containing as high as 400 $PPM_v$ carbonyl sulfide. Methanol consumption for the process averages 5 to 10 mols per mol of carbonyl sulfide in the feed stream. Methanol consumption is reduced to as low as 3 mols per mol of carbonyl sulfide if multiple beds or towers in series are used. Potassium hydroxide consumption averages 1.2 to 1.5 mols per mol of carbonyl sulfide. The reaction products produced are 2.5 pounds per pound of carbonyl sulfide. The process will operate over a wide range of temperatures and pressures as long as the propane remains in the liquid phase. However, methanol consumption decreases with decreasing temperature. Total energy consumption for the process is only 0.02 brake horsepower (BHP) to pump methanol for a typical plant treating 8000 barrels per day (B/D) of propane which contains 100 $PPM_v$ of carbonyl sulfide.

The two contacting towers 14 are installed in parallel so that one column can be removed from operation to replenish the potassium hydroxide supply after it has been consumed. If the untreated LPG stream contains greater than about 100 $PPM_v$ of carbonyl sulfide then two contacting towers in series or multiple beds in the same tower may be used with methanol being injected into the LPG stream upstream of each tower or bed. The solid potassium hydroxide provides good contact with the LPG stream while minimizing losses of potassium hydroxide and consumption of methanol. In addition, using solid potassium hydroxide produces an LPG product that meets GPA dryness specifications. The use of solid potassium hydroxide tends to minimize the consumption of methanol because only enough methanol is needed for injection to wet the outer surface of the potassium hydroxide. As the LPG-methanol mixture progresses up the tower 14 it comes in contact with potassium hydroxide that has progressively fewer reaction products on the surface thereof thereby providing a more efficient removal process of the carbonyl sulfide. In a solution tank the methanol and LPG mixture would come in contact with essentially a constant composition solution and consume greater amounts of methanol. Also, solid potassium hydroxide, as opposed to a solution of potassium hydroxide, is employed because the reaction products, including water, would remain in a solution of potassium hydroxide and cause the LPG to become wet. In addition any water in the system might lead to the formation of undesired hydrogen sulfide by the reaction between the water and the carbonyl sulfide.

Solid potassium hydroxide is available in flake, granular and walnut size; however, plugging of the bed is reduced when the latter is used and it, therefore, is preferred. Channeling through the bed is reduced by using a vessel height to diameter ratio of 3 or higher based on bed height (not vessel height). Superficial velocity, i.e. velocity of the liquid hydrocarbon stream through an empty vessel, should be below about one foot per minute to minimize carryover and achieve low consumption of methanol and potassium hydroxide. Such low velocities were employed in the illustrative successful treatment of propane streams given above. The low propane stream velocity also allows time for the reaction products to settle to the bottom of the towers.

The potassium hydroxide-methanol process of the invention provides essentially 100 percent removal of carbonyl sulfide from liquid hydrocarbon streams and has the advantages of a simple design, low capital cost, quick installation, low operating costs (minimal energy input for pumping methanol), minimal utility requirements and dry effluent liquid hydrocarbons without downstream dehydration.

More information relating to the background, advantages, operation and other features of the invention are disclosed in a paper, entitled "Treating Propane for Removal of Carbonyl Sulfide" by M. B. Mick presented to the National Gas Processors Association, Mar. 24, 1976 and published on pages 114–125 of the Proceedings of the Fifty-Fifth Annual Convention of the Gas Processors Association, Mar. 22–24, 1976, the disclosure of which is hereby incorporated by reference.

Changes and modifications may be made in the illustrative embodiments of the invention shown and described herein without departing from the scope of the invention as defined in the appended claims.

Having fully described the nature, objects, method and advantages of our invention we claim:

1. In a process for removing carbonyl sulfide from an essentially water-free liquid hydrocarbon stream the improvement comprising:

mixing said hydrocarbon stream containing carbonyl sulfide with liquid methanol;

passing said mixed methanol-hydrocarbon stream upwardly through a bed of solid potassium hydroxide arranged in a reaction vessel, said potassium hydroxide, methanol and carbonyl sulfide reacting to form reaction products $H_2O$ and $KSCOOCH_3$;

the superficial velocity of said hydrocarbon stream being less than about one foot per minute; and separating said reaction products from said treated hydrocarbon stream by downward flow of said reaction products and upward flow of said treated hydrocarbon stream in said vessel to provide essentially 100% removal of said carbonyl sulfide from said liquid hydrocarbon stream.

2. A process as recited in claim 1 including periodically removing said reaction products from said vessel.

3. A process as recited in claim 2 in which the particles of said solid potassium hydroxide are walnut size.

4. A process as recited in claim 3 in which said bed of potassium hydroxide is cylindrically shaped and has a height to diameter ratio of 3 or more.

5. A process as recited in claim 1 in which said carbonyl sulfide in said separated treated hydrocarbon stream is less than one part per million by volume.

* * * * *